United States Patent [19]

Vickers et al.

[11] 4,140,253

[45] Feb. 20, 1979

[54] GUN CARRIER

[76] Inventors: Charles K. Vickers; Patricia A. Vickers, both of 605 Clare Dr., Washington, Pa. 15301

[21] Appl. No.: 824,275

[22] Filed: Aug. 15, 1977

[51] Int. Cl.[2] ..... F41C 33/00

[52] U.S. Cl. ..... 224/1 R; 2/DIG. 6; 24/204; 224/5 R

[58] Field of Search ..... 224/0.5, 1 R, 1 A, 2 A, 224/2 B, 2 D, 2 E, 2 F, 5 R, 5 A, 5 E, 5 J, 5 Z, 5.1, 26 R, 26 B; 43/21.2; 42/94; 46/1 E; 2/DIG. 6; 24/204

[56] References Cited

U.S. PATENT DOCUMENTS

| | | | |
|---|---|---|---|
| 2,873,902 | 2/1959 | Decker | 224/1 R |
| 3,191,652 | 6/1965 | Benson et al. | 224/2 A X |
| 3,321,068 | 5/1967 | Beach | 24/204 X |
| 3,664,558 | 5/1972 | Tolliver | 224/1 R |
| 3,700,147 | 10/1972 | Vaughn | 224/2 A |
| 3,819,094 | 6/1974 | Hyde | 224/26 R X |

*Primary Examiner*—Trygve M. Blix
*Assistant Examiner*—Winston H. Douglas
*Attorney, Agent, or Firm*—Buell, Blenko & Ziesenheim

[57] ABSTRACT

Apparatus for carrying a gun upright comprises a flexible carrying unit which fastens to the belt of the gunner and is provided with an element of a quick connect-disconnect separable fastener. The mating element is affixed to the gun stock so that when the gun is held upright its stock is connected to the carrying unit through the fasteners, thus transferring the weight of the gun to the belt of the wearer.

5 Claims, 3 Drawing Figures

GUN CARRIER

This invention relates to sportman's guns. It is more particularly concerned with apparatus which transfers the weight of a gun being carried to the belt of the gunner.

For safety reasons, guns should be carried upright with the muzzle up. Although the weights of modern guns are moderate, the effort expended in carrying an eight-pound gun over any considerable distance is not inconsiderable. Slings have long been used by the military but the time required to unsling a gun and bring it to firing position is such that slings are not favored by hunters.

It is an object of our invention to provide apparatus for transferring the weight of a gun carried upright to the belt of the gunner. It is another object to provide such apparatus which can be quickly engaged with or disengaged from a gun. It is a further object to provide such apparatus which offers alternative positions for carrying a gun. Other objects of our invention will appear in the course of the description thereof which follows.

Our invention comprises a flexible carrying unit which fastens to the belt of the gunner and is provided with an element of a quick connect-disconnect separable fastener and the other fastener element, which is affixed to the gun stock so that when the gun is held upright its stock is connected to the carrying unit through the fasteners, transferring the weight of the gun to the belt of the wearer.

Figure 1:
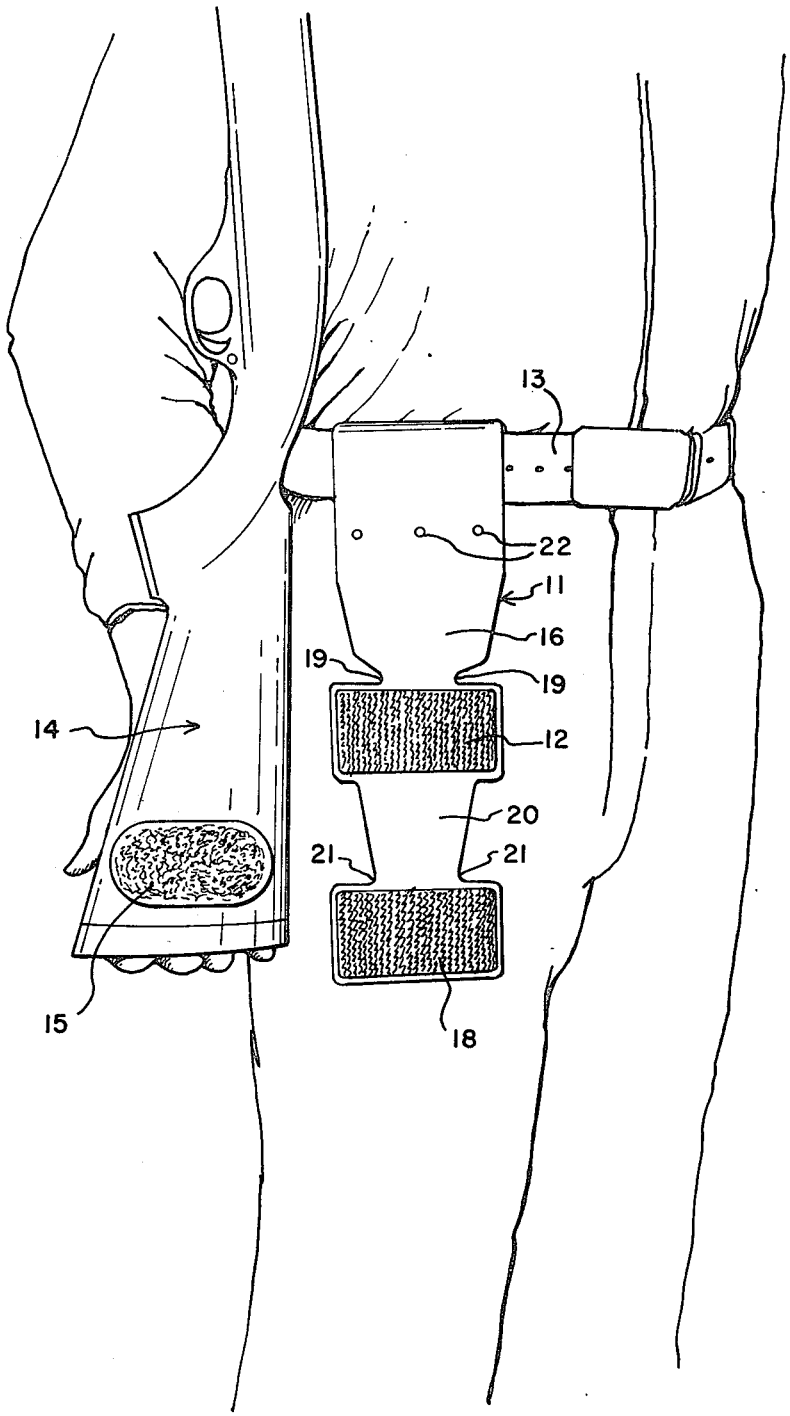
Figure 2:
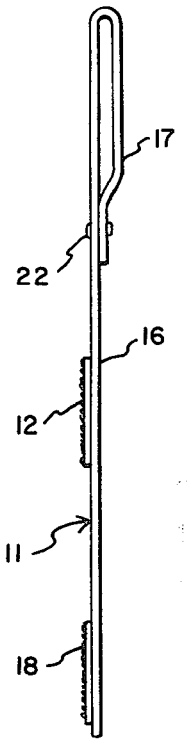
Figure 3:
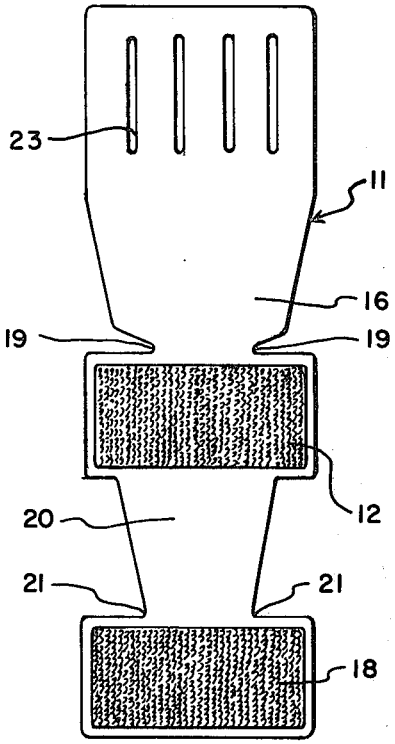

Embodiments of our invention presently preferred by us are illustrated in the attached Figures in which:

FIG. 1 is a sketch of a portion of a gun and a portion of the body of the gunner, showing both portions of our apparatus in place, FIG. 2 is an end elevation of the flexible carrying unit shown in FIG. 1, FIG. 3 is a side elevation of another form of flexible carrying unit.

Flexible carrying unit 11 of FIGS. 1 and 2 comprises a strip of flexible leather-like material 16 having its upper end turned over and fastened with rivets 22 to form a loop 17 through which the belt 13 of the gunner is passed. Strip 16 hangs from belt 13 against the leg of the gunner, as is shown in FIG. 1. At the bottom end 20 of strip 16 is affixed an element 18 of a quick connect-disconnect separable fastener pair. A second such element 12, identical with element 18 is affixed to strip 16 intermediate its upper and lower ends. Affixed to the stock 14 of the gun on one side thereof, near the butt, is the cooperating element 15 of the fastener pair.

Strip 16 above fastener element 12 is narrowed by notches 19 on each side so that the width of the portion between the notches is about half of the width of fastener element 12. The portion 20 of strip 16 between fastener elements 12 and 18 is likewise narrowed by notches 21 in the same way. Fastener element 15 is conveniently affixed to gun stock 14 by a thermoplastic adhesive so that it can be removed if desired without marring the gun stock. When he desires to carry his gun, the gunner raises it into upright position until fastener element 15 is at the level of fastener element 12 or 18, whichever position he chooses. He then presses gun stock 14 against strip 16 so that their respective fastener elements interlock and the weight of the gun is thus transferred to his belt 13 through strip 16. He must, of course, steady his gun in this position by one hand. When he wishes to use his gun, he pulls it upwardly and away from his body until the corresponding fastener units pull apart.

The quick connect-disconnect fasteners are preferably of the type mechanically interacting by functional surfaces, such as are disclosed in U.S. Pat. No. 2,717,437 of Sept. 13, 1955 and U.S. Pat. No. 3,009,235 of Nov. 21, 1961, both issued to G. DeMestral.

In one form sold under the trademark "Velcro", the device comprises two layers of woven fabric of the velvet type in which loops have been cut to form hooks. The securing elements consist on the one part of numerous closely spaced plastic hooks and on the other part of numberous closely spaced loops. When hook and loop elements are pressed into face-to face contact, the hooks catch into the loops and the two elements are retained firmly together until intentionally separated by pulling the two elements apart. Upon separation, the hooks flex open and disengage from the loops. After separation the hooks close up and return to their original hook shape. However, other types of quick connect-disconnect fasteners may be used, such as snap fasteners.

The notches 19 and 21 permit fastener elements 12 and 18 to conform to the curve of the gun stock thereby providing a secure hold during normal movements of the gunner. The height of those fastener elements thus can be smaller relative to their width than would be the case otherwise. In this way, two fastener elements can be accommodated on strip 16 so as to provide alternative carrying positions for the gun. Our invention, of course, also comprises a carrying unit 11 with only one fastener element.

In FIG. 3 is illustrated a second embodiment of the carrying unit 11 of our invention. Here, strip 16 is provided at its upper ends with four spaced vertical slots 23, through which the belt of the wearer can be passed. This embodiment of our invention is slightly less bulky than the embodiment of FIGS. 1 and 2.

In the foregoing specification we have described presently preferred embodiments of our invention; however, it will be understood that our invention can be otherwise embodied within the scope of the following claims.

We claim:

1. Apparatus for transferring the weight of a gun carrier upright to the clothing of the gunner comprising a strip of flexible material having means at its upper end for attachment to the clothing of the gunner so as to depend therefrom and a pair of mating quick connect-disconnect separable fasteners, one of said fastener elements being affixed to the strip at its lower end and extending substantially the entire width of the lower strip portion to which the fastener element is affixed and the other element being provided with means for affixing it to a gun stock, the lower end of the strip is notched on each of its sides above and adjacent the quick connect-disconnect separable fastener element affixed to the lower end portion so that a width of the strip between the notches is about half of the width of the lower end strip portion fastener element thereby permitting the fastener element affixed to the lower end strip portion to conform to a curve of the gun stock.

2. Apparatus of claim 1 including a second quick connect-disconnect separable fastener element affixed to the strip spaced from the first said element so as to provide two alternative gun carrying positions.

3. Apparatus of claim 1 in which the mating quick connect-disconnect separable fastener elements comprise projecting elements of stiff filamentary material which interlock when the fastener elements are pressed face-to-face and separate when the fastener elements are pulled apart.

4. Apparatus of claim 1 in which the means at the upper end of the strip of flexible material are adapted to attachment to a belt.

5. In combination, a gun stock, and article of clothing, means for transferring the weight of the gun stock to the article of clothing comprising a strip of flexible material having means at its upper end of attachment to the article of clothing so as to depend therefrom, and a pair of mating quick connect-disconnect separable fasteners, one of said fastener elements being affixed to the strip at its lower end and extending substantially the entire width of the lower strip portion to which the fastener element is affixed and the other element being affixed to the gun stock, the lower end of the strip is notched on each of its sides above and adjacent the quick connect-disconnect separable fastener element affixed to the lower end portion so that a width of the strip between the notches is about half of the width of the lower end strip portion fastener element thereby permitting the fastener element affixed to the lower end strip portion to conform to a curve of the gun stock.

* * * * *